US008655008B2

(12) United States Patent
Jagne

(10) Patent No.: US 8,655,008 B2
(45) Date of Patent: Feb. 18, 2014

(54) CONFIGURABLE HEADSET SUPPORT WITH VARIABLE POSITIONING

(75) Inventor: Cherno Waka Jagne, Monroe, WA (US)

(73) Assignee: Cherno Waka Jagne, Bothell, WA (US)

( * ) Notice: Subject to any disclaimer, the term of this patent is extended or adjusted under 35 U.S.C. 154(b) by 269 days.

(21) Appl. No.: 12/985,221

(22) Filed: Jan. 5, 2011

(65) Prior Publication Data

US 2012/0170788 A1 Jul. 5, 2012

(51) Int. Cl.
*H04R 25/00* (2006.01)
*H04R 1/02* (2006.01)

(52) U.S. Cl.
USPC ..... 381/388; 381/386

(58) Field of Classification Search
USPC ..... 381/86, 370, 384, 388
See application file for complete search history.

(56) References Cited

U.S. PATENT DOCUMENTS

| | | | | |
|---|---|---|---|---|
| 2,149,341 | A | 3/1939 | Harrison | |
| 2,527,656 | A | 10/1950 | Reinsdorf | |
| 2,629,023 | A | 2/1953 | La Fitte | |
| D211,033 | S | 5/1968 | Majesty | |
| 4,075,438 | A * | 2/1978 | Kappel | 381/388 |
| 4,154,478 | A | 5/1979 | Cohune | |
| 4,440,443 | A | 4/1984 | Nordskog | |
| 4,797,934 | A | 1/1989 | Hufnagel | |
| 5,335,285 | A | 8/1994 | Gluz | |
| 6,273,865 | B1 | 8/2001 | Perez | |
| 6,280,066 | B1 * | 8/2001 | Dolan | 362/414 |
| 6,480,613 | B1 * | 11/2002 | Choi | 381/386 |
| 6,721,434 | B2 * | 4/2004 | Polk et al. | 381/388 |
| 6,772,853 | B2 | 8/2004 | Yang | |
| 7,188,896 | B2 | 3/2007 | Embach | |
| 2006/0176655 | A1 * | 8/2006 | Hillman et al. | 361/683 |
| 2008/0111408 | A1 | 5/2008 | Duran | |
| 2009/0169044 | A1 * | 7/2009 | Kashiwagi et al. | 381/384 |

FOREIGN PATENT DOCUMENTS

| | | | |
|---|---|---|---|
| CN | 2879819 | Y | 12/2005 |
| JP | 2000050989 | A | 2/2000 |

* cited by examiner

*Primary Examiner* — Brian Ensey

(57) ABSTRACT

A method and a device are disclosed for a portable headset including an attached earphone and a support structure configured to position the earphone in a random position by user action. In various embodiments, the support structure is further configured to be detachably coupled to various different earphones. The portable headset is further configured to be attachable to different seats or anchor points.

19 Claims, 3 Drawing Sheets

CONFIGURABLE HEADSET SUPPORT WITH VARIABLE POSITIONING

TECHNICAL FIELD

This application relates generally to audio headsets. More specifically, this application relates to a method and apparatus for a headset support configured to be positioned randomly to hold the headset in the proximity of a user's head.

SUMMARY

In aspects of present disclosure, a headset is disclosed including a flexible arm configured to be randomly positioned in a three-dimensional space within the reach of the flexible arm, the flexible arm having an anchor end and a free end, a support structure base coupled with the anchor end of the flexible arm and configured to be attached to an anchor point, and an earphone attached to the free end of the flexible arm.

In further aspects of the present disclosure, a headset support structure is disclosed including a support structure base configured to be removably attached to an anchor surface, and a flexible support structure arm having an anchor end and a free end, wherein the anchor end is configured to be attached to the support structure base, and the free end is configured to be attached to an earphone.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1:
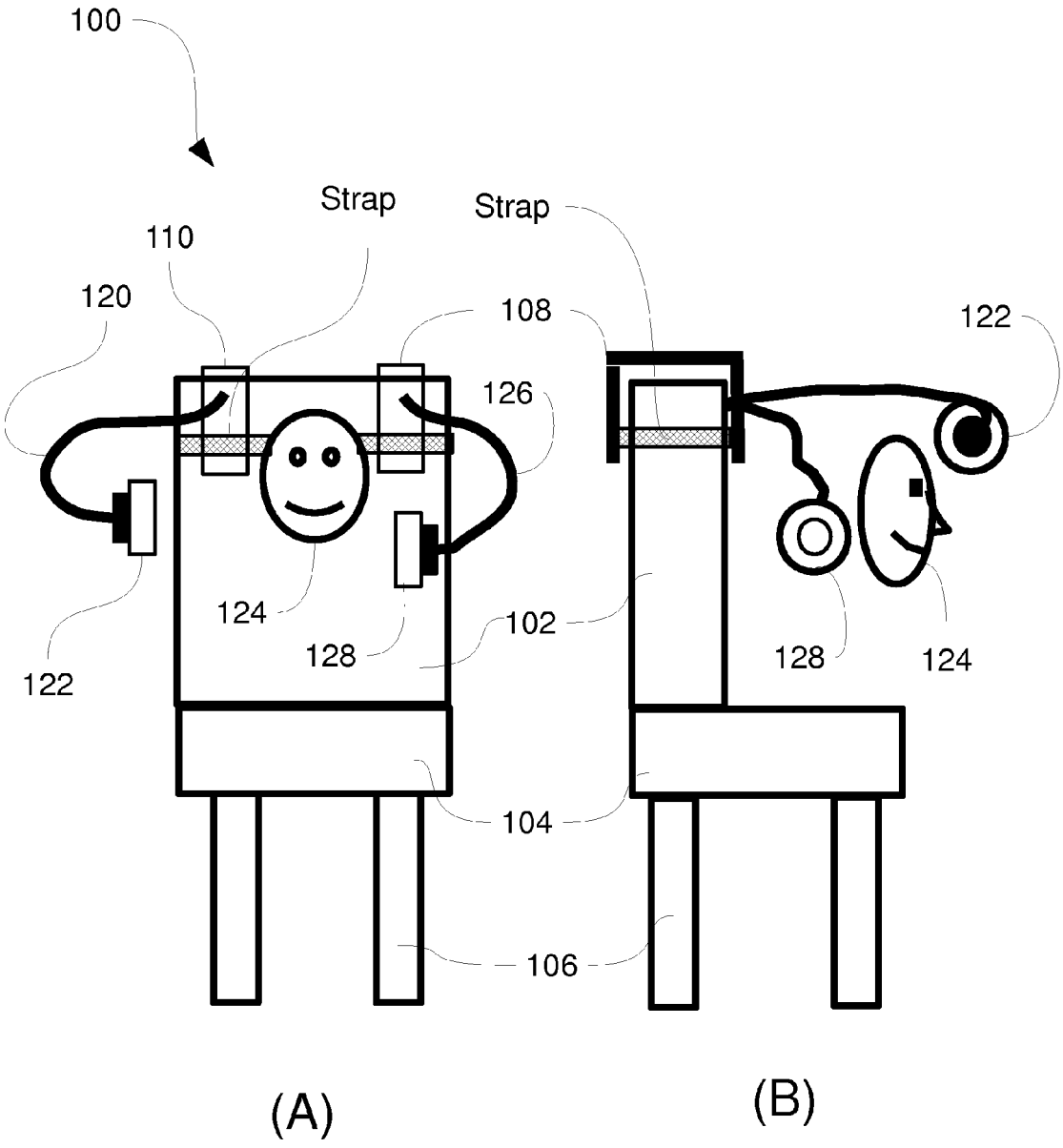
FIG. 1A shows a front view of an example chair suitable for using a headset with random positioning.
FIG. 1B shows a side view of the example chair of FIG. 1A.

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed. In addition, while the following description references using certain types of earphones, it will be appreciated that the disclosure may be used with other types of earphones and audio devices such as supra-aural earphones, small speakers, and the like.

Briefly described, a method and a device are disclosed for a portable headset including an attached earphone and a support structure configured to position the earphone in a random or arbitrary position by user action. In various embodiments, the support structure is further configured to be detachably coupled to various different earphones. The portable headset is further configured to be attachable to different seats and anchor points.

With the advent of digital media, ubiquity of computers, and improvements in the availability and transfer rates of wired and wireless computer networks, such as the Internet, the variety of multimedia entertainment available to people has exploded. Commensurate with this increased, technologically based availability of multimedia content, the variety of multimedia devices, such as video players and music players have also exploded. Due to the wide availability of content and easy access to multimedia content, many people listen to music or other content in close proximity to other people. As such, the use of headsets and earphones has increased for privacy as well as courtesy reasons in public places, as well as in the home. For example, a user listening to music in an office environment close to other coworkers is required to be as unintrusive as practical and not intrude on other his coworker's privacy by playing loud music. Similarly, in a public transportation environment, such as a bus or an airplane, users may be required to use headsets to avoid bothering others with loud noise while listening to music or watching a movie on handheld devices or computer screens.

Many forms and varieties of headsets are available for different tastes and applications. The different types of earphones may be broadly categorized at least as circumaural, supra-aural, earbuds, and canalphones.

Circumaural earphones are almost like a sound proof room. The ear pads that fit around the outside of the ears in a circular design keep all the sounds within the space between the ear pad and ear. These earphones are effective for filtering out ambient sound, as well.

Supra-aural earphones have ear pads that sit on the ears, rather than around the ears. They are typically connected by an adjustable band that stretches over the top of the head, and the pad between the speaker and the ears usually will consist of some sort of foam.

Earbuds are some of the most convenient and inexpensive earphones available. The earbuds are placed directly outside the ear canal without actually enveloping it. For the most part, these ear buds do not have the same crisp sound of a circumaural earphones, but they can be used quite well when relying on volume to block out any surrounding noise.

Canalphones are similar to earbuds, except that these earphones fit directly into the ear canal. Not only do these earphones provide good quality sound but good portability as well, since the ear pads are usually made of silicone rubber or elastomer. The rubber and elastomer are used to keep the earphone in the ear and also block external noise. This earphone is commonly used by athletes or people who may move around during work.

When using earphones that do not fit inside the ear, such as supra-aural earphones, when in a stationary position, such as when exercising on a treadmill or sitting down in a chair while working, it is desirable to have the earphones held near the user's ear without being supported by or be in actual contact with the user's head or body. In such circumstances, the user may desire to position the earphones in close proximity to his ears and focus on his work or exercise and not be bothered with positioning and holding the earphones on his ears. This arrangement may be particularly useful when user makes small movements without moving away. For example, when a user is sitting in an office chair, he may move around slightly but not move away from his chair. Similarly, a user exercising on stationary device, such as a treadmill, may move around slightly. Additionally, having a heavy and/or cumbersome headset around the head may be generally irritating and undesirable for many users.

FIG. 1A shows a front view of an example chair suitable for using a headset with random positioning. Seating arrangement 100 includes a seat back 102, a seat 104, legs 106, coupled with headset support structure bases 110 and 108 attached to flexible positioning arms 120 and 126 and earphones 122 and 128, respectively. User 124 uses seating arrangement 100 to listen to sounds coming out of earphones 122 and 128 positioned by the user near the user's ears.

In various embodiment, support structure bases 110 and 108 may be attached or integrated together as one unit, while in other embodiments, support structure bases 110 and 108 may be removably coupled with the seat back 102 independently. In other various embodiments, support structure bases 110 and 108 are removably attached to an anchor point, such as the chair back, by other means such as a hook and loop fastener pads (see FIG. 2) like a VELCRO® pad or patch, by bolts, by magnetic force, by straps (see FIGS. 1 A & B) wrapped around the seat back, by mating components, or by other techniques suitable for attaching such structures to an anchor point like a chair, strong enough to resist the forces normally exerted and hold the support structure attached to the chair. Such forces include the weight of the headset support structure and the earphone positioning forces exerted by the user.

In various embodiments, support structure bases 110 and 108 are coupled with an anchor end of flexible support structure arms 120 and 126, respectively, a free end of which support structure arms may be randomly and stably (that is, staying in the given position without returning to a previous position like a spring) positioned in a three-dimensional (3-D) volume or grid, within the reach of the flexible arms, by simply pulling the free ends to the desired corresponding spatial positions. Random or arbitrary stable positioning of the free endpoint of a flexible arm may be implemented in several ways. A common technique for maintaining a stable position of the free end includes using frictional components that resist motion, and thus resist a change of the flexible arm's shape or a change in the position of its free endpoint. The resistance of such frictional components to motion is generally only overcome by exertion of sufficient (manual) force to move the frictional members with respect to each other and thus, effect deformation in the flexible arm, as further described with respect to FIGS. 4A and 4B below.

Those skilled in the art will appreciate that different techniques may be used to provide random, stable, spatial position of a flexible arm without departing from the spirit of the present disclosure. For example, three sliding members arranged to move along each of the 3-D orthogonal dimensions may be used to position earphones randomly. Another technique for 3-D positioning of the free end of the flexible arm is to use spring-balanced or tension-balanced lever sections in a multi-lever arrangement, similar to those found in drafting table lamps.

FIG. 1B shows a side view of the example chair of FIG. 1A. In various embodiments, headset support structure base 108 straddles seatback 102 to hold flexible arms 120 and 126 around the head of user 124. As described with respect to FIG. 1A and FIG. 2 below, support base may be attached to the seat back using other techniques than shown in this figure.

Figure 2:
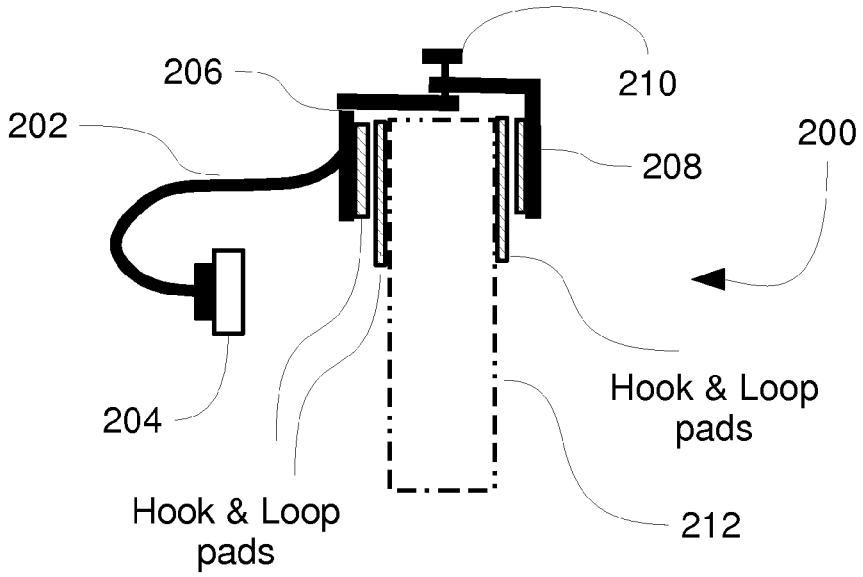
FIG. 2 shows an example headset and headset support arrangement.

FIG. 2 shows an example headset and headset support arrangement. In various embodiments, arrangement 200 includes adjustable support structure base including a sliding members 206 and 208 coupled together by a fastener 210. Sliding member 206 is coupled with flexible arm 202 coupled to earphone 204. Support structure base sliding members are fit onto seat back 212 to securely hold the headset in place.

In various other embodiments, adjustable support structure base is fastened to an anchor surface or anchor point (to which the support base is fastened/attached), such as the seat back, using other techniques such as clamps to hold onto the anchor point, VELCRO® pair of pads attached each to the seat back and to the support bases, magnetic forces provided by natural or electric magnets, pre-fabricated mating components attached to the chair and the support bases, and the like. In other various embodiments, seat back 212 has the support base permanently attached.

In some embodiments, headset support structure base is attached to surfaces other than a chair back. For example, the support base may be attached to a wall, a column, handlebars of an exercise machine like a treadmill, or any other surface or structure close to which a user may sit or stand for extended periods and listen to music, watch a movie, and the like.

Figure 3:
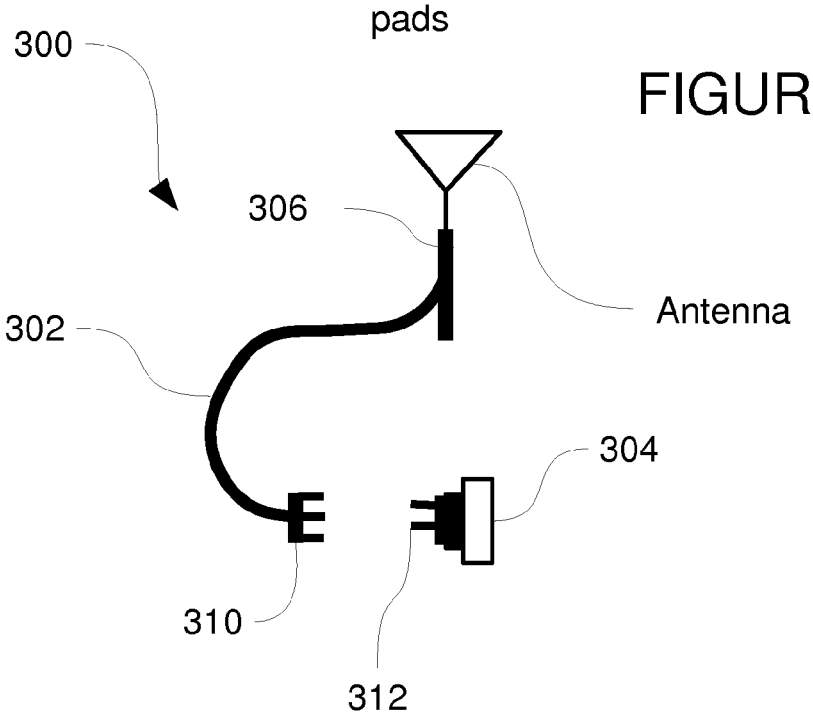
FIG. 3 shows an example headset support structure arm configured to attach to various earphones.

FIG. 3 shows an example headset support structure arm configured to attach to various earphones. In various embodiments, support structure arm configuration 300 includes support structure base 306 coupled with the anchor end of support structure arm 302 having a support-side interface 310 configured to be coupled to an earphone-side interface 312 of earphone 304.

In various embodiments, support-side interface 310 and earphone-side interface 312 constitute a mechanical interface only, while in other embodiments, they constitute both a mechanical and an electrical interface to supply audio signals to earphone 304. With this configuration, various earphones 304 may be coupled with the support structure arm to provide different types of characteristics and satisfy different user tastes and/or requirements. In other various embodiments, earphones 304 use a wireless device and corresponding technique, such as WiFi (based on IEEE 802.xx wireless standard), IR (Infra Red), and the like, to receive audio signals from an audio source, such as a radio or a computer. In still other embodiments, a mechanical interface between the support structure arm and earphone is configured to substantially attach to any shape or form of earphone by physically holding the earphone, without needing any special mating or corresponding interface on the side of the earphone itself. For example, a clamp mechanism attached to the free end of the support structure flexible arm may be used to grab the earphone to hold it in position. In other embodiments, earphone 304 is fixed to support structure arm 302 permanently as an integrated unit.

In various embodiments, support structure arm 302 may be made of metal to serve as a supplemental radio antenna to improve the signal reception of a radio device attached to the earphone, the headset support structure, and the like. Generally, larger antennas provide better signal receptions and as such, extending a radio antenna (see FIG. 3) using support structure arm 302 may improve signal reception or quality.

Figure 4:
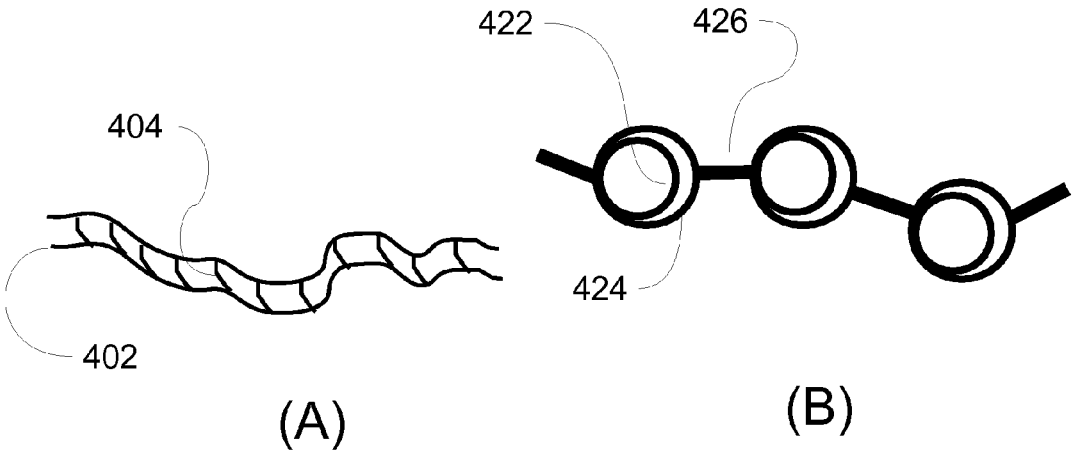
FIG. 4A shows an example frictional tube.
FIG. 4B shows an example ball-and-socket chain.

FIG. 4A shows an example frictional tube. In various embodiments, frictional tube 402 is formed by twisting a profile strip in a spiral fashion to create overlapping edges 404. Frictional tube 402 may be used as a flexible support structure arm, where the overlapping edges 404 engage each other at each turn of the spiral. When the formed tube is bent, the overlapping edges are forced to slide relative to each other while in friction, but remain in the final position when the force is removed.

FIG. 4B shows an example ball-and-socket chain. In various embodiments, each link in the ball-and-socket chain includes ball 422, socket 424 enclosing ball 422, and connecting link 426, connecting one link to the next. This is another technique for forming a flexible arm. Ball 422 and socket 424 are fit tightly together with sufficient force to create friction between the two components. Like frictional tubes, the flexible arm thus formed may be bent or positioned by overcoming the friction between the balls and sockets and rotating each socket around the corresponding ball in the chain until a desired position or shape is reached. Then removing the force will allow the flexible arm to maintain its position.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A headset comprising:

a continuously flexible arm configured to be randomly positioned in a three-dimensional space within the reach of the flexible arm, the flexible arm having an anchor end and a free end;

a support structure base coupled with the anchor end of the flexible arm and configured to be attached to an anchor point; and an earphone attached to the free end of the flexible arm, wherein the flexible arm is made of metal and comprises an antenna for radio waves, making the antenna an integral part of the support structure.

2. The headset of claim 1, further comprising a mechanical interface between the anchor end of the flexible arm and the earphone.

3. The headset of claim 1, wherein the flexible arm comprises a frictional tube.

4. The headset of claim 1, wherein the flexible arm comprises a ball-and-socket chain.

5. The headset of claim 1, wherein the support structure base comprises a clamp.

6. The headset of claim 1, wherein the support structure base includes a strap for attaching the support structure base to an anchor surface.

7. The headset of claim 1, wherein the support structure base includes hook and loop pads.

8. The headset of claim 1, wherein the earphone includes a mechanical interface configured to removably attach the earphone to the free end of the flexible arm.

9. The headset of claim 1, wherein the free end of the flexible arm comprises a clamp arrangement adapted to attach to and hold substantially any earphone.

10. A headset support structure comprising:

a support structure base configured to be removably attached to an anchor surface; and a continuously flexible support structure arm having an anchor end and a free end, wherein the anchor end is configured to be attached to the support structure base, and the free end is configured to be attached to an earphone, and wherein the continuously flexible support structure arm is made of metal and comprises an antenna for radio waves, making the antenna an integral part of the support structure.

11. The headset support structure of claim 10, further comprising a mechanical and an electrical interface at the free end configured to couple to an earphone.

12. The headset support structure of claim 11, wherein the electrical interface is used to transmit an audio signal to the earphone.

13. The headset support structure of claim 10, wherein the support structure base comprises a clamp.

14. The headset support structure of claim 10, wherein the support structure base comprises a Velcro pad.

15. The headset support structure of claim 10, wherein the support structure base comprises two independent sections, each section independently supporting one earphone, configured to be attached to an anchor surface.

16. The headset support structure of claim 10, wherein the flexible support structure arm comprises a frictional tube.

17. The headset support structure of claim 10, wherein the flexible support structure arm comprises a ball-and-socket chain.

18. The headset support structure of claim 10, wherein the free end of the flexible support structure arm is configured to attach to substantially any earphone.

19. The headset support structure of claim 10, wherein the flexible support structure arm is configured to be positioned by user action at a random point within a three dimensional volume.

* * * * *